US006103314A

United States Patent [19]

Kinnunen

[11] Patent Number: 6,103,314

[45] **Date of Patent: *Aug. 15, 2000**

[54] METHOD AND ASSEMBLY FOR COATING A PAPER WEB

[75] Inventor: Jorma Kinnunen, Järvenpää , Finland

[73] Assignee: Valmet Corporation, Helsinki, Finland

[ * ] Notice: This patent issued on a continued prosecution application filed under 37 CFR 1.53(d), and is subject to the twenty year patent term provisions of 35 U.S.C. 154(a)(2).

[21] Appl. No.: 08/740,246

[22] Filed: Oct. 25, 1996

[30] Foreign Application Priority Data

Oct. 26, 1995 [FI] Finland ..... 955096

[51] Int. Cl.[7] ..... B05D 1/28; B05D 3/12; B05C 1/12

[52] U.S. Cl. ..... 427/428; 427/356; 427/359; 427/361; 118/106; 118/126; 118/244; 118/248; 118/258

[58] Field of Search ..... 427/356, 361, 427/359, 428; 118/244, 251, 258, 126, 106, 119, 248, 262, 63

[56] References Cited

U.S. PATENT DOCUMENTS

| | | | |
|---|---|---|---|
| 3,110,612 | 11/1963 | Gottwald et al. . | |
| 4,335,675 | 6/1982 | Waldvogel . | |
| 4,601,256 | 7/1986 | Poterala | 118/126 |
| 4,761,309 | 8/1988 | Embry . | |
| 4,858,553 | 8/1989 | Westergard et al. . | |
| 4,887,547 | 12/1989 | Sommer et al. . | |
| 4,961,968 | 10/1990 | Shands et al. | 427/356 |
| 4,963,397 | 10/1990 | Mayer et al. . | |
| 5,368,893 | 11/1994 | Sommer et al. | 427/348 |
| 5,520,732 | 5/1996 | Sarfati | 118/234 |
| 5,547,509 | 8/1996 | Neider et al. | 118/68 |

FOREIGN PATENT DOCUMENTS

| | | |
|---|---|---|
| 1860/61 | 10/1969 | Finland . |
| 920039 | 1/1992 | Finland . |
| 44 46 373 A1 | 6/1996 | Germany . |
| 1337429 | 11/1973 | United Kingdom . |
| 2 272 850 | 11/1993 | United Kingdom . |

*Primary Examiner*—Shrive Beck
*Assistant Examiner*—Michael Barr
*Attorney, Agent, or Firm*—Cohen, Pontani, Lieberman & Pavane

[57] ABSTRACT

A method and apparatus for coating a moving paper or paperboard web (1), in which coating mix is applied to the surface of the web (1) by means of a rotating applicator roll (11). The coating mix applied to the web (1) is levelled with the help of smoothing means (4, 5, 6) acting against a backing roll (8). The web (1) to be coated is presses against the applicator roll (11) with the help of an endless band (2), which is adapted to pass over at least the applicator roll (11), the backing roll (8) and an adjustment roll (10) placed upstream of the applicator roll so that the band (2) with the web (1) backed by the band (2) are together deflected to pass over the applicator roll (11) along their path between the adjustment roll (10) and the backing roll (8).

23 Claims, 1 Drawing Sheet

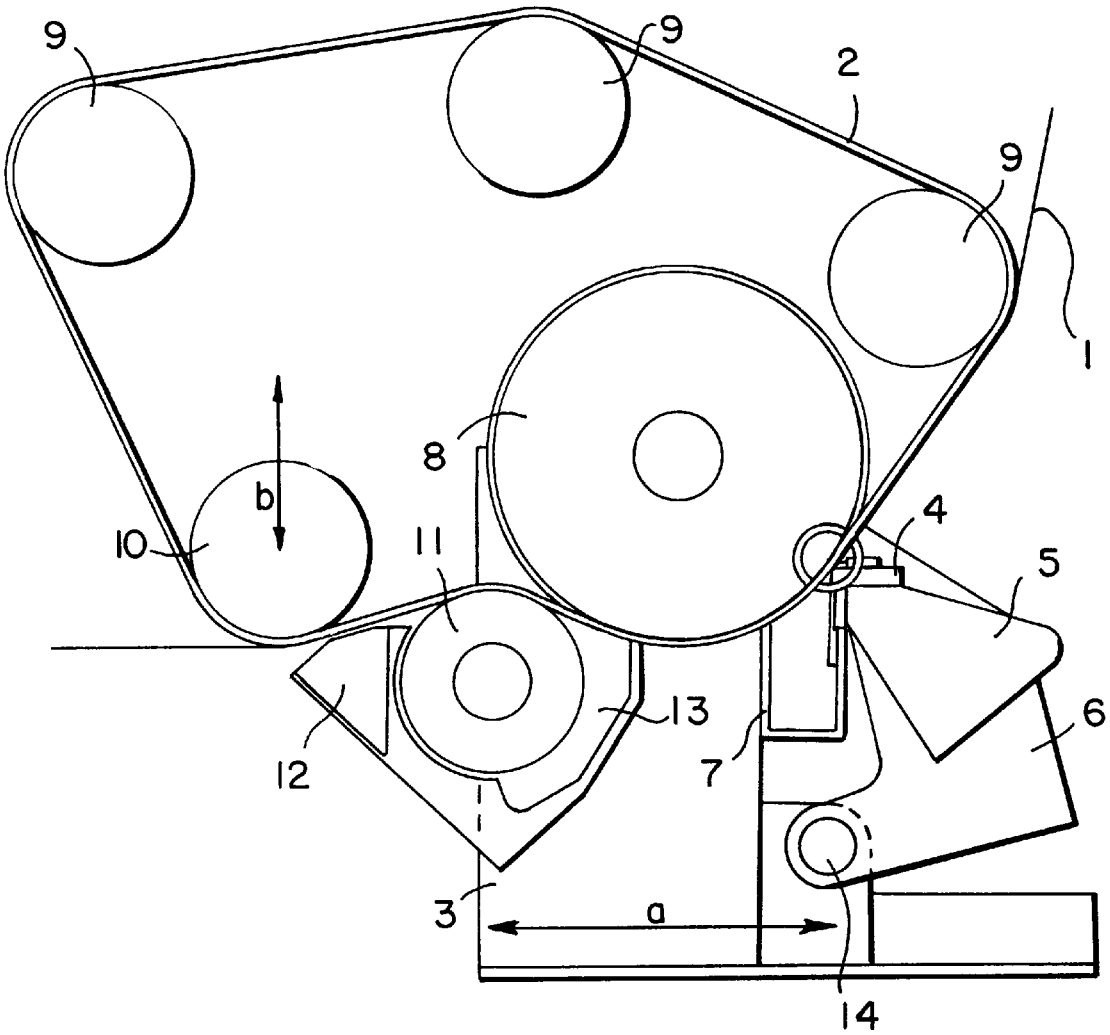
9
9
2
9
1
8
b
10
11
4
5
13
6
12
7
3
a
14

METHOD AND ASSEMBLY FOR COATING A PAPER WEB

FIELD OF THE INVENTION

The present invention relates to a method and apparatus for coating a paper or paperboard web, in which method the coating mix is applied to the web being coated by means of an applicator roll.

BACKGROUND OF THE INVENTION

To improve the printability of paper, the base paper made in a paper machine may be coated with a variety of coating formulations. The applied coat must be smooth and have a constant coat weight after it is applied to a moving web in a slurried form, and excess water is removed from the applied coat in dryers. The application of the coat may be divided into two steps, comprising the application of the coat and subsequent smoothing of the coat combined with metering of the applied coat.

A method used in the art is coat application to the paper web by means of a roll applicator, in which the web is passed in intimate contact over a rotating applicator roll. While the applicator roll is usually rotated along with the web at a speed lower than the web speed, counter-directional rotation and other types of differential speed arrangements are also known in the art. The coating mix is transferred onto the applicator roll surface by means of a metering device apparatus, or alternatively, the applicator roll is adapted to rotate in a coating mix pan. From the applicator roll surface, the coating mix is transferred to the surface of the moving web, and subsequent to application, the coat is further smoothed by doctoring away the excess coat with a doctor blade, levelling rod or air knife. The web to be coated can be pressed against the applicator roll by a variety of arrangements. In early coaters, a guide roll was placed to both sides of the applicator roll, and the web was kept against the applicator roll with help of the guide rolls. In such an assembly, the maximum usable applicator nip pressure between the web and the applicator roll is determined by the web tensile strength, which means that the maximum application pressure remains rather low. Such an arrangement is suited for low web speeds only, because the air layer travelling along with the web easily becomes entrained at high web speeds in the nip between the web and the applicator roll, thus causing surface defects in the coated web. Hence, this method is today used for coating webs other than paper in locations operated at sufficiently low web speeds. The web speed of such a low-speed coater may be increased marginally by injecting air to the backing side of the web, thus pressing the web against the applicator roll.

In paper manufacture, roll application occurs against a backing roll. In such coaters, the web is passed via a gap or nip formed between the applicator roll and the backing roll, whereby a higher nip pressure can be used. By virtue of the elevated nip pressure, the coating mix can be efficiently forced into the base paper in the roll applicator, which in conjunction with the swelling of the fibers and increase in the bulk volume facilitates well-controlled application of heavy coats. The applied coat weight is initially often many-fold in comparison with the final coat weight. Therefore, the deep penetration of the coat and large volume of doctored coating mix requires a great doctoring force to be controlled in the smoothing of the coat. Such a great doctoring force in turn imposes a heavy stress on the moist web and causes web breaks. It has been noted, that the major portion of web breaks occur at blade coaters, which means that an improvement in the reliable function of coaters would have a major impact on the production efficiency of paper manufacture and total availability performance of the paper manufacturing machinery.

At concurrent high web speeds, roll applicators are hampered by splashing of the coating mix, which is caused by the splitting of the coat film as the web exits the nip between the applicator roll and the backing roll. Here, a part of the coat film remains adhered to the web, while the other part sticks to the surface of the applicator roll, whereby the coat film will become extended between the web and the applicator roll forming droplets that are centrifugally thrown out from the nip. The larger the tangential exit angle of the web leaving the applicator roll, the more splashing will occur, because this condition is related to a more violent splitting of the coat film. Hence, concurrent coaters tend to use large-diameter rolls to reduce the tangential exit angle of the web leaving the applicator roll. Simultaneously, the larger-diameter of the applicator roll extends the application zone length and improves the application result. However, fabrication of such large-diameter applicator rolls to exact tolerances combined with good dynamic balancing is expensive, and, with the trend toward larger-diameter applicator rolls, the design and location of the coater in a factory building becomes ever more difficult simply due to the larger size of the coater machinery.

As roll applicators, however, can achieve heavy coats with good quality of the coat, reduction or elimination of the above-described shortcomings is most challenging.

SUMMARY OF THE INVENTION

It is an object of the present invention to provide a roll applicator apparatus with a wider control range of application zone parameters and essentially improved runnability.

The goal of the present invention is achieved by supporting the web during coating by means of a backing band against the applicator roll and at the doctoring step. An adjustment roll is placed in front of the applicator roll.

The invention provides significant benefits.

The present invention facilitates significantly wider adjustment of coating parameters. The distance between the point of application and the point of doctoring can be made adjustable, whereby the amount of water penetrating into the web, and thus, the degree of drying of the coat prior to doctoring can be controlled. By increasing this distance, more water can penetrate into the web, thus increasing the solids content of the applied coat to result in, a thicker coat being left on the web during doctoring. The application zone can be made longer than in a backing roll assembly, because the backing band may be arranged to conform to the contour of the applicator roll, and the application zone length in the machine direction can be controlled by adjusting the position of the movable adjustment roll. By virtue of the longer application zone, the application result and the quality of the applied coat are improved. The tangential exit angle between the band-backed outgoing web and the applicator roll can be made smaller than that of a backing-roll supported web, whereby a smoother splitting of the coat film is obtained resulting in less splashing.

The backing band supports the web so that the dynamic forces imposed thereon by web speed and tensile stress variations will be inflicted on the backing band, rather than on the web, resulting in an essential reduction in the magnitude of web-breaking forces. Furthermore, the use of a band to back-up the web is capable of flattening pouches caused by swelling of the web, since both the band and the web are passed in a concave manner over the applicator roll and in a convex manner over the doctor blade.

Other objects and features of the present invention will become apparent from the following detailed description considered in conjunction with the accompanying drawing. It is to be understood, however, that the drawing is intended solely for purposes of illustration and not as a definition of the limits of the invention, for which reference should be made to appended claims.

BRIEF DESCRIPTION OF THE DRAWING

The FIGURE is diagrammatic side elevational view of an embodiment of coating assembly of the present invention.

DETAILED DESCRIPTION OF THE PRESENTLY PREFERRED EMBODIMENTS

In the following the invention will be examined in greater detail by making reference to the appended drawing illustrating a preferred embodiment of the invention.

Referring to the diagram, the coater apparatus shown therein utilizes a conventional arrangement for applying a coating mix-onto a web 1. The smoothing device is a doctor blade unit comprising a support beam 5 with a doctor blade assembly 4 attached thereto, a coating mix pan 7 and rotating arms 6, which are each connected at one ends with a pivotal joint 14 to the frame 3 of the coater and at another end to the ends of the support beam 5. In the vicinity of the doctor blade unit 4–7 is a large-diameter backing roll 8 for backing the web 1 at the point of doctoring. The web 1 passes through the nip between the backing roll 8 and the doctor blade. As the different versions of doctor blade assemblies and their function are known to those versed in the art, a detailed description of these parts of the coater may be omitted herein.

The applicator assembly of the coater comprises an applicator roll 11, a nozzle applicator device 12 and coating mix pan 13. Supported all its way by an endless band 2, the web 1 to be coated is adapted to pass over the surface of the applicator roll 11 and through the nip between the backing roll 8 and the doctor blade unit 4–7. The band 2 enters the applicator roll 11 over an adjustment roll 10 and therefrom travels to the backing roll 8 passing over the surface of the roll. From the backing roll 8, the band is guided via three guide rolls 9 back to the adjustment roll 10. The paper or paperboard web 1 to be coated meets the band at the adjustment roll 8. The positions of the adjustment roll 8, the applicator roll 11 and the backing roll 8 are adapted so as to make the band 2 pass over a curved segment of the surface of the applicator roll 11. In this fashion, the application zone can be made longer, which improves the transfer of the coating mix onto the web 1. The application zone length can be varied by moving the adjustment roll 10 in the direction of arrow b relative to the applicator roll 11. While a vertical movement of adjustment is used in the embodiment shown in the diagram, other movement directions of the adjustment roll 10 may be necessary if the travel of the band 2 and the location of the rolls are altered. By moving the adjustment roll 10 downward, the application zone length will be increased, and respectively, an upward movement of the roll shortens the application zone length. Obviously, a compensation facility for the band travel length change due to a change in the position of the adjustment roll 10 must be arranged. Such a compensation is easiest to implement by means of a separate tensioning roll, whose movement may be adapted to occur automatically with the movement of the adjustment roll 10, whereby the band tension can be kept constant during the adjustment of the application zone length. The tensioning roll may be one of the guide rolls 9, or alternatively, the adjustment roll 10 may be arranged to move along a nonlinear path so curved that a constant band tension is maintained.

In practice, the band tension adjustment is required because it offers a method of controlling the application pressure. As the pressure p in the application zone is proportional to the quotient of the tension k of the band 2 divided by the radius r of the applicator roll 11, the application zone pressure can be controlled by either adjusting the band tension or altering the radius of the applicator roll 11. Since the latter alternative of changing the applicator roll radius is cumbersome, pressure adjustment in the application zone by means of a separate tensioning roll is more advantageous. While it is also feasible to design the path of the adjustment roll 10 such that the roll acts as a tensioning roll only, this arrangement fails to offer the adjustment facility of the application zone length. The actual web tension control in coating takes place by adjusting the web tension with the help of differential speed control over the coater station.

In the most preferred embodiment of the present invention, the distance between the applicator roll 11 and the doctor blade unit 4–7 is made adjustable in the direction marked by arrow a in the drawing. Referring to the drawing, it is obvious that as a change of the position of the applicator roll 11 also affects the application zone length, it is advantageous in this embodiment to use the adjustment roll 10 for setting the application zone length, while the band tension is adjusted with a separate tensioning roll. In this fashion, the other control parameters can be kept constant during the adjustment of one control variable. The application process in this embodiment can be controlled in a flexible manner by altering the application zone length, application pressure and dwell time between the point of application and the point of doctoring. Besides, conventional adjustments of doctor blade profile, angle and loading offer additional control parameters as well as the control of the speed of the applicator roll. The applicator assembly may thus be optimized to maximize the coat quality under given running conditions. The external factors affecting the control of the coater include the properties of the coating mix applied in combination with the base paper, web speed and desired coat weight.

To achieve a constant coat profile, an extremely smooth surface and a constant thickness of the band are important in the selection of the band material. Hence, the band must have a smooth surface that may contain only small micropores. It must be noted that the web cannot be adhered to a nonporous band by means of, e.g., a vacuum applied to the rear side of the band. However, relatively strong adherence of the web to the band surface is provided by adhesion between the moist band and the web. Additionally, the adhesion is slightly increased due to the static charging of the web prior to coating as well as after coating due to increased adhesion of the wet web to the band surface. Moreover, the applicator roll and the levelling device impose an additional pressure, keeping the web against the band. The band material may be selected from the group of pliable metals such as stainless steel, brass and aluminium and different polymers that can be processed into a smooth band of sufficient tensile strength.

The function of the above-described assembly is as follows. The web 1 to be coated is passed to the coater from the previous paper-making stage and is guided to meet the band 2 at the adjustment roll 10. The web 1 attaches by adhesion to the band 2 and passes on the band to the applicator roll 11. On the approach side of the web 1 onto the applicator roll 11 is adapted a nozzle applicator device 12 suited for metering coating mix onto the applicator roll 11. The applicator roll 11 rotates codirectionally with the machine direction of the web 1 at a reduced speed of approx. 15–25% with respect to the speed of the web 1 and transfers the coating mix from its surface onto the web 1. An excess amount of coat is applied onto the applicator roll 11, and that part of the coating mix not transferred from the roll to the web 1 is taken back to the coating mix pan 13. The applicator roll 11 can be scraped clean from the coat, or alternatively, the coat may be allowed to circulate on the surface of the roll 11 back to the application zone.

In the application zone, the weight of the thick coat layer transferred onto the web 1 is very high, typically approximately 200–250 g/m$^2$. Because the maximum coat weight that can be applied in a controlled manner in a single coating step of roll application to the web surface is approximately 20 g/m$^2$, the applied coat must be doctored heavily to achieve a desired coat thickness. Conventionally, the coat is smoothed with the help of a doctor blade that imposes a strong stress on the web. In the assembly according to the present invention, the stress imposed on the web is further transmitted to the band, whereby the risk of web breaks is reduced essentially. The excess coat removed by the doctor blade from the surface of the web 1 is taken back to the coating mix pan 7 of the doctor blade unit. The entire doctor blade unit is supported by the above-described rotating arms 6, thus facilitating the rotation of the entire assembly away from the backing roll 8 for cleaning, blade change and other maintenance operations. From the doctor blade unit 4–7, the web 1 is passed, supported by the band 2, onto the first guide roll 9, which serves to detach the web from the band 2 and pass the web further to the dryer.

Besides that described above, the present invention may have alternative embodiments. Instead of a doctor blade, the smoothing of the coat can be made using a levelling rod or an air knife, but these devices may not necessarily provide sufficiently strong levelling force for a large amount of applied coat, thus limiting the use of these alternatives to special applications. Different arrangements of the guide roll set and other rolls are also possible, because the approach and exit directions of the web may be varied in different coater designs. In fact, the assembly according to the present invention is easy to modify according to local needs. One feasible design has the band adapted to pass over the backing roll, the guide roll and the applicator roll only. However, in such an assembly the angle of the band over the backing roll, and respectively, the angle of the band over the adjustment roll become very large, which means that the band must be made from a sufficiently pliable material to permit sustained bending of the band over the rolls at high web speeds. In addition to the above-described alternatives, one feasible design has the applicator roll made movable toward the band and away therefrom, thus facilitating adjustment of the application zone length and band tension.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawing is not necessarily drawn to scale but that it is merely conceptual in nature. It is the intention, therefore, to be limited only as indicated by the scope of the claims appended hereto.

What is claimed is:

1. A method of coating a moving paper or cardboard web, comprising:

applying a coating mix to a surface of a web using a rotating applicator roll to which coating mix is simultaneously applied thereto, the web wrapping around a portion of a circumference of the applicator roll to form a coating mix application zone along a length of the web;

levelling the coating mix applied to the surface of the web using a smoothing means upon the surface of the web being coated, a portion of the web where the smoothing means operates upon the web being backed by a backing roll;

supporting the web as coating mix is applied thereto until the applied coating mix is levelled using an endless band which presses the web against the portion of the circumference of the applicator roll and which passes partially around the backing roll between the backing roll and the web, the band passing over an adjustment roll before the band is applied to the web;

pressing the web with the band against the applicator roll as coating mix is applied to the web by the applicator roll, the applicator roll being positioned so that no nip is formed by the backing roll against the applicator roll; and providing a means for adjusting the length of the coating mix application zone by adjusting the positions of at least one of the adjustment roll and the applicator roll.

2. The method of claim 1, wherein an angle of tangential approach of the web supported by said band to said applicator roll is adjustable.

3. The method of claim 1, wherein the position of the applicator roll is adjustable.

4. The method of claim 3, wherein the position of the applicator roll is adjustable by adjusting a distance between the applicator roll and the smoothing means.

5. The method of claim 1, further comprising adjusting tension in the band.

6. The method of claim 5, wherein the tension in the band is adjusted by adjusting the position of the applicator roll.

7. The method of claim 1, wherein the position of the adjustment roll is adjustable.

8. The method of claim 1, wherein the positions of the adjustment roll and the applicator roll are adjustable.

9. The method of claim 1 further comprising:

providing a means for adjusting an amount of pressure applied by the band to the web against the applicator roll in the coating mix application zone.

10. The method of claim 3, wherein the position of the applicator roll is adjustable by moving the applicator roll toward or away from the band.

11. An apparatus for coating a moving paper or cardboard web, comprising:

a rotating applicator roll for applying a coating mix to a surface of the web;

an applicator for transferring the coating mix to said applicator roll;

a backing roll positioned downstream of said applicator roll with respect to a direction of travel of the web so that no nip is formed by the backing roll against the applicator roll;

a smoothing means for levelling the coating mix applied to the surface of the web by said applicator roll, the smoothing means operating upon the surface of the web being coated, a portion of the web operated upon by said smoothing means being backed by said backing roll;

an adjustment roll positioned upstream of said applicator roll with respect to the direction of travel of the web; and an endless band positioned so as to travel partially around said adjustment roll and partially around said backing roll and so as to support the web as coating mix is applied thereto by said applicator roll, as the web travels from said applicator roll to said backing roll, and as said smoothing means levels coating mix applied to the surface of the web;

wherein said adjustment roll, said applicator roll and said backing roll are positioned so that the web supported by said band partially wraps around said applicator roll in a coating mix application zone along a length of travel of the web, said band being positioned to press the web against the coating mix application zone of the applicator roll, wherein a length of the coating mix application zone is adjustable by adjusting the positions of at least one of said adjustment roll and said applicator roll.

12. The apparatus of claim 11, wherein relative position of said adjustment roll and said applicator roll is adjustable so that an angle of tangential approach of the web supported by said band to said applicator roll is adjusted upon adjusting the position of said adjustment roll.

13. The apparatus of claim 11, wherein a distance between said applicator roll and said smoothing means is adjustable.

14. The apparatus of claim 11, further comprising means for adjusting tension in said band.

15. The apparatus of claim 11, wherein said tension adjusting means comprises means for adjusting the position of said applicator roll.

16. The apparatus of claim 11, wherein the position of said adjustment roll is adjustable.

17. The apparatus of claim 11, wherein the position of said applicator roll is adjustable.

18. The apparatus of claim 11, wherein the position of said applicator roll relative to said smoothing means is adjustable.

19. The apparatus of claim 11, wherein said smoothing means comprises a doctor blade.

20. The apparatus of claim 11, further comprising:

a means for adjusting an amount of pressure applied by the band to the web against the applicator roll in the coating mix application zone.

21. The apparatus of claim 11, further comprising:

a means for adjusting the position of said applicator roll relative to the position of said smoothing means so as to adjust a dwell time between applying the coating mix to the surface of the web and leveling the coating mix applied to the surface of the web.

22. The apparatus of claim 11, wherein the positions of the adjustment roll and the applicator roll are adjustable.

23. The apparatus of claim 11, wherein the position of the applicator roll is adjustable by moving the applicator roll toward or away from the band.

* * * * *